US005172432A

United States Patent [19]

Béland

[11] Patent Number: 5,172,432

[45] Date of Patent: Dec. 22, 1992

[54] SWIMMING POOL AERATING DEVICE

[76] Inventor: Fernand Béland, 853D, Boul. des Chutes, Drummondville, Québec, Canada, J2B 4H3

[21] Appl. No.: 822,125

[22] Filed: Jan. 17, 1992

[51] Int. Cl.[5] ..... E04H 4/00; E03C 1/02

[52] U.S. Cl. ..... 4/507; 4/541.004; 4/492

[58] Field of Search ..... 239/428.5, DIG. 23, 239/587.1; 4/492, 507, 541, 542, 544, 541.1, 541.3, 541.4; 128/66

[56] References Cited

U.S. PATENT DOCUMENTS

| | | | |
|---|---|---|---|
| 2,848,111 | 8/1958 | Gare | 210/169 |
| 3,271,790 | 9/1966 | Schneider et al. | 4/542 X |
| 3,577,571 | 3/1969 | Bellinson | 4/492 |
| 3,745,994 | 7/1973 | Kane | 128/66 |
| 3,749,424 | 7/1973 | Greene | 4/507 X |
| 3,897,338 | 7/1975 | Bennett et al. | 210/169 |
| 4,461,703 | 7/1984 | Vetter | 4/490 |
| 4,520,514 | 6/1985 | Johnson | 4/492 X |
| 4,542,854 | 9/1985 | Mattis | 4/542 X |
| 4,972,531 | 11/1990 | Gravatt | 4/542 |

*Primary Examiner*—Henry J. Recla
*Assistant Examiner*—David J. Walczak
*Attorney, Agent, or Firm*—Pierre Lesperance; Francois Martineau

[57] ABSTRACT

It is important healthwise to oxygenate water in swimming pools in order to kill the mainly anaerobic microorganisms that may come to grow therein. Chemical agents are nowadays in current use, however, they are expensive, and also they do have damaging effects on the tissues of bathers particularly for the cornea. By mounting an oxygenating device at the water outlet of the recirculating system of the swimming pool, growth of anaerobic organisms is prevented. The present aerating device includes a spherical nozzle with a water flow channel, coupled to the recirculating system main water duct outlet, and a straw, engaging at one end transversely into the water flow channel and escaping at the opposite end above the water line. Ambient air is fed to and dissolved in the recirculated filtered water by the venturi effect generated by the forced circulation of water through the conventional recirculating water filtering system.

2 Claims, 2 Drawing Sheets

SWIMMING POOL AERATING DEVICE

FIELD OF THE INVENTION

This invention elates to swimming pool accessories for purifying the water thereof.

BACKGROUND OF THE INVENTION

In swimming pools, the water need to be regularly filtered and cleaned from marcroparticles as well as micro-organisms. Macroparticles are removed from the water by a recirculating water duct network, coupled to the swimming pool walls Micro-organisms, including fungi, yeast, algae, bacteria and others, are attacked mainly by chemical agents poured at periodic intervals into the swimming pool water.

By definition, a large body of stagnating water constitutes an anaerobic milieu, i.e. that it contains a very low if any concentration of dissolved oxygen (from the air). Accordingly, only anaerobic micro-organisms will usually survive into such large bodies of stagnating water. The chemical agents used in swimming pools as bactericidal agents are accordingly directed toward these anaerobic organisms.

Unfortunately, the action of such chemical agents is not always thorough, as they will tend to fall to the bottom of the swimming pool after a while. Moreover, these chemical agents (e.g. chlorine based) have irritating or damaging effects on the tissues of bathers, particularly for the skin and cornea. These chemical agents are also damaging to the environment and for this reason, are not considered to be ecologically sound. In addition, chemical bactericidal agents are very expensive and, since they must be used in substantial quantities at regular intervals in the large body of water enclosed in the swimming pool basin, they constitute a recurrent and important variable cost for the owner of the swimming pool. Alternate means must therefore be devised to at least complement the conventional agents that skill these micro-organisms responsive for foul odors, non-aesthetic coloration of the swimming pool water, eventual build-up of unappealing colonies of such organisms, and possibly transmission of disease to bathers.

This is one reason why water oxygenation is found useful. By increasing the ratio of dissolved air in the water, the mainly anaerobic micro-organisms living in the swimming pool water can no longer grow, since oxygen is lethal for them. In some water recirculation systems, this water oxygenation occurs about the conventional filtering apparatus of the water recirculating network of the swimming pool, i.e. relatively far away from the water outlet. The water recirculating systems take water from the swimming pool basin through a water inlet, bring this contaminated water through a duct network to a macro-particle filter, and return this filtered water along the duct network into the swimming pool through a water outlet. Hence, it takes time for the dissolved air in the recirculated water to reach the large body of water in the swimming pool, wherein some of the dissolved air may have already begun to escape from the water carrier.

OBJECTS OF THE INVENTION

The gist of the invention is to provide water oxygenation means located about the filtered water outlet of the recirculating water network of a swimming pool, to control growth of anaerobic micro-organisms into the swimming pool water.

An important object of the invention is to provide directional means for enabling adjustment of the water flow orientation about said water oxygenation means, whereby the pool may have additional features typical of whirlpool baths, water massage devices, and the like.

A further object of the invention is to provide such water oxygenation means as disclosed hereinabove, which will adapt to various water outlet fittings of swimming pools.

A general object of the invention is to substantially improve the efficiency of water oxygenation operations in swimming pools.

An object of the invention is to provide a water aerator device as disclosed above, which will control bacteria count particularly during periods of several days when a thermally insulating sheet (popular name; "solar blank") is applied at the water line of the swimming pool when the latter is not in use.

An important object of the invention is to substantially reduce the need for bactericidal chemical agents in—and thus the cost associated with—the day to day maintenance of water quality control in swimming pools.

Other corollary objects of the invention include: simple manufacturing process therefore, ease of installation and of use, durability and trouble-free operation, and to create constant water movement in the swimming pool to provide a soothing and restful appeal to the onlooker.

SUMMARY OF THE INVENTION

Accordingly with the stated objects of the invention, there is disclosed an oxygenating device to be located at a submerged water outlet port of a water filtering recirculating system of a swimming pool enclosing a large body of water, and for use in dissolving oxygen into the filtered water returned into said large body of water, said oxygenating device consisting of: (a) nozzle means, destined to be submerged into said swimming pool water; (b) oxygen feed means, for feeding oxygen to said nozzle means; and (c)mount means, for mounting said nozzle means against said recirculating system outlet port; said nozzle means including an axial channel having an upstream end, opening into said water outlet port, and a downstream end, opening into said large body of water, for flow through passage of said filtered water; said oxygen feed means including oxygen intake means, and oxygen outlet means located into said nozzle channel intermediate said upstream and downstream ends thereof; wherein said filtered water flow through said nozzle channel generates a venturi effect about said oxygen outlet means, and thus, an oxygen flow from said oxygen intake means, through said oxygen outlet means, into said channel where oxygen is dissolved in said filtered water before escape thereof into said large body of water.

DETAILED DESCRIPTION OF THE INVENTION

Figure 2:
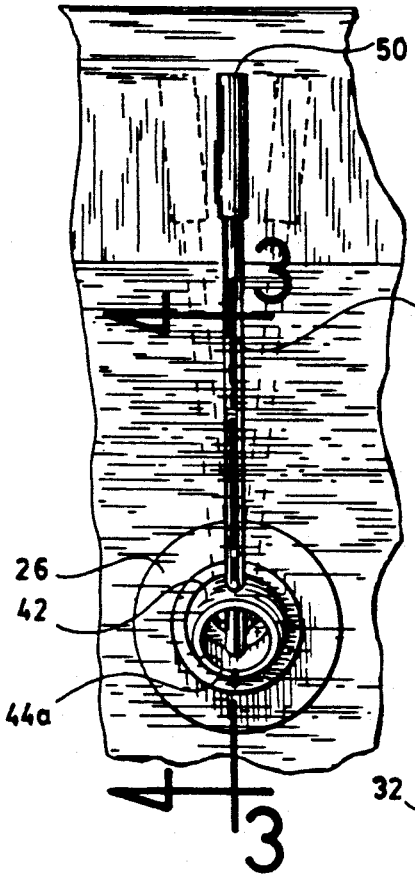
FIG. 2 is a view of the aerating device at right angle relative to FIG. 1.
Figure 1:
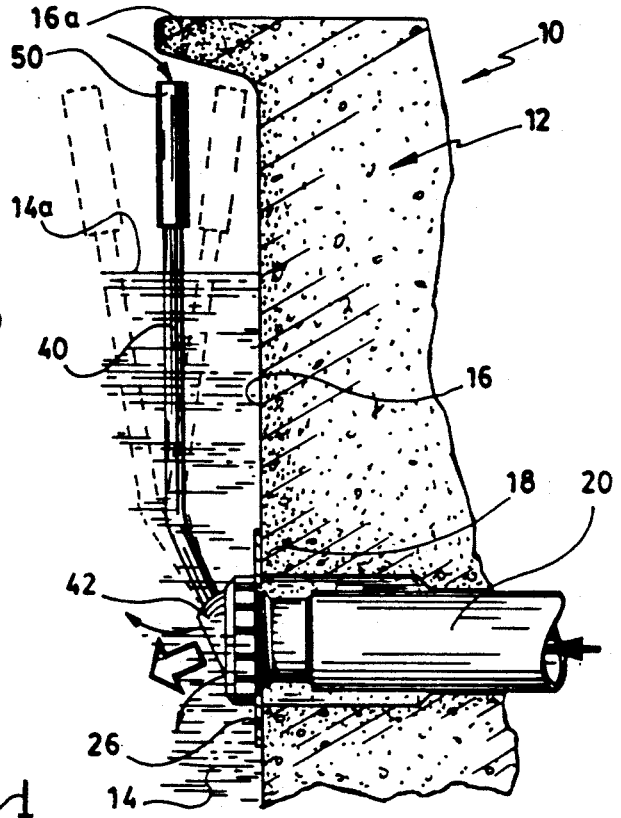
FIG. 1 is a vertical section of a swimming pool side wall with the female type water outflow fitting being provided with the aerating device of the invention, and suggesting how the aerating device control handle can be pivoted to adjust the directional air flow into the swimming pool water.

Swimming pool 10 defines a basin 12 enclosing water 14. Basin 12 includes a peripheral side wall 16 having a top flange 16*a* overlying the water line 14*a*. Water 14 is recirculated through a conventional water filtering system, including a water inlet, water outlet, water pump means, macro-particle filter means and duct network interconnecting all of the latter. The water outlet is generally mounted to basin wall 16 beneath water line 14*a*, at 18. Water outlet 18 is connected to the water inlet (not shown) by a tubular member 20.

Figure 3:
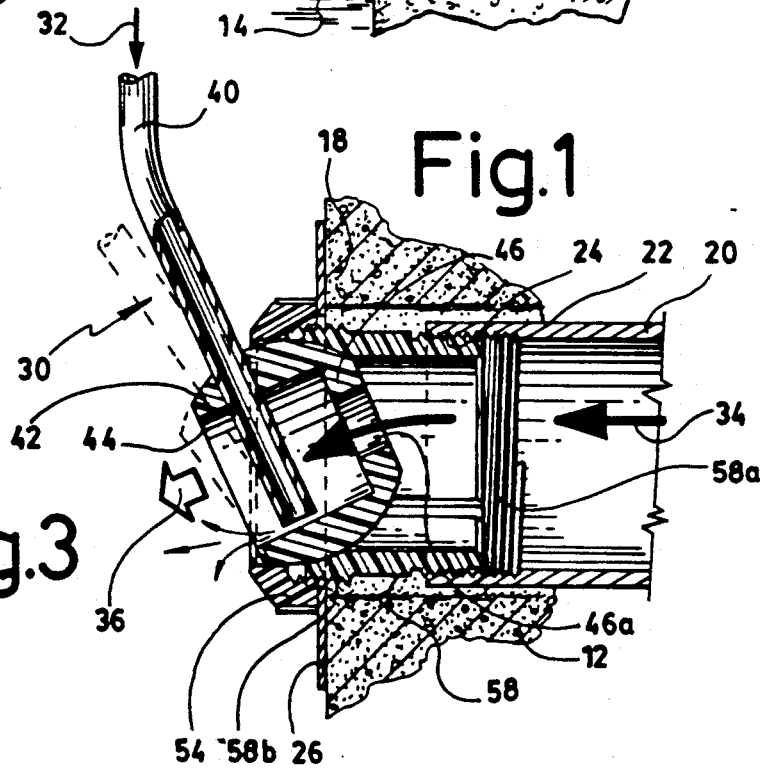
FIG. 3 is an enlarged section about line 3—3 of FIG. 2.
Figure 4:
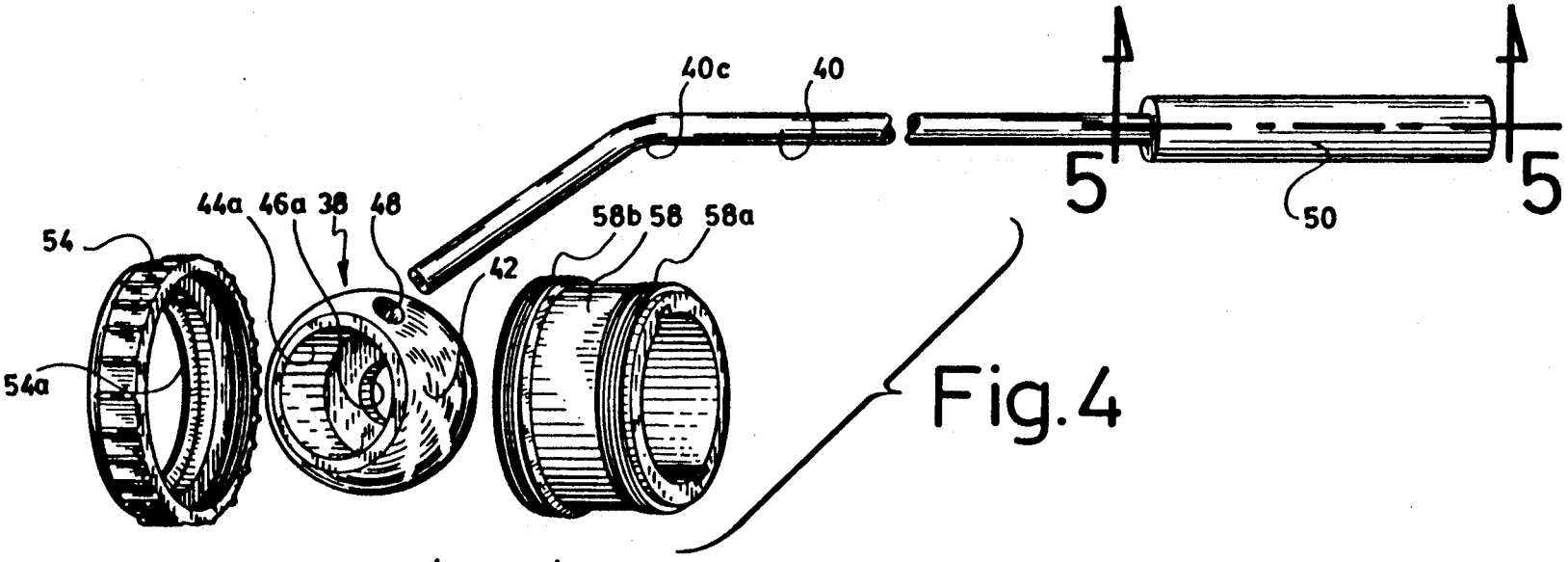
FIG. 4 is an exposed view of the aerating device for use with the female type outlet fitting of water recirculating system.

In the embodiment of FIG. 3, tubular member 20 is of the female type, having a water outlet end 22 projecting short of the through bore 18 made in wall 16, and defining screw threads 24 on its radially inward surface. In the alternate embodiment of FIG. 3*a*, the outlet end of tubular member 20' is of the male type, at end 22' projecting through and beyond the through-bore 18 in wall 16 and defining screw threads 24' on its radially outward surface. An annular plate 26 is conventionally fixedly applied against wall 16 to circumscribe bore 18.

According to the invention, an aerator device 30 is provided to feed ambient air—arrow 32—to filtered water-arrow 34—from tube 20 or 20' about outlet 18, whereby oxygenated water—arrow 36—is returned into basin 12. By "oxygenated" water is meant water with a relatively high percentage of air dissolved therein. Aerator 30 consists of two main components: a waterflow channel member 38, and an air flow straw member 40 for feeding air into the channel member radially thereof.

More particularly, channel member 38 defines a semi-spherical nozzle 42 with a large diameter axial cavity 44 closed at one end wall 46 and defining a mouth 44*a* at its opposite end. A bore 48 is made in spherical body 42 radially of cylindrical channel 38, for releasable frictional engagement by straw 40. Straw 40 consists of a small diameter tube, long enough to extend beyond water lien 14*a*. Preferably , to the free end section 40*a* of tube 40 is mounted an enlarged handle 50, for free passage of ambient air therethrough. Channel member wall 46 includes a through bore 46*a*, axially of cavity 44. Preferably, axial bore 46*a* is diametrally larger than radial bore 48, but should be diametrally small than axial cavity 44. Axial cavity 44 is in turn diametrally smaller than the flow through channel fonetwork duct 20.

Figure 3A:
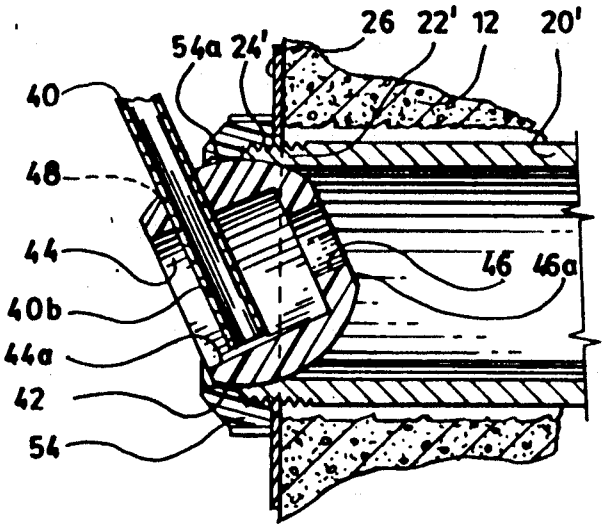
FIG. 3*a* is a view similar to FIG. 3, but with the aerating device mounted into a male type water outflow fitting.

In the embodiment of FIG. 3*a*, nozzle 42 defines a diametrally largest section, generally about radial bore 48 and being larger than the inner diameter of tube 20', and a diametrally smallest section, generally about wall 46 and being smaller than the inner diameter of tube 20'. Accordingly, the end portion 46 of spherical ball or nozzle 42 is insertable through the mouth 24' of tube 20, as suggested in FIG. 3*a*.

It is understood that axial bore 46*a* and axial cavity 44 form together a coaxial water flow channel, with diametrally smaller axial bore 46*a* being at the upstream end thereof and diametrally lager nozzle mouth 44*a* being at the downstream end thereof.

In the embodiment of FIG. 3*a*, aerator device 30 further includes a third component namely, a large annular nut 54 foe threadingly meshing with the radially outward screw threads 24' of tube 20'. Nut 54 includes a radially inturned flange 54*a* at one edge thereof. Nut 54 is radially inwardly larger than said largest section of spherical body 42, except about radial flange 54*a*.

Hence, after partial engagement of portion 46 of nozzle 42 into tube mouth 22', nut 54 may be screwed around the tube mouth threads 24' to rotatably mount nozzle 42 against the swimming pool after outlet 18. Straw 40 is then frictionally inserted into radial bore 48. By tilting eyeball 42 with handle 50, the direction of oxygenated water flow 36 may be adjusted accordingly.

the inner mouth—air outlet port—40*b* of straw 40 inside channel 44 is brought to a position closely spaced from the radially inner cylindrical wall of hollow sphere 42, and maintained at the selected position by the friction fit of tube 40 into radial bore 48. Hence, the flow of filtered water from upstream pat 46*a* will generate a low pressure area about this radial gap. The induced low pressure about this portion of channel 44 adjacent mouth 40*b* will in turn bias air flow from outer mouth 40*a* through inner mouth 40*b*, into channel 44, and outwardly thereof-along with filtered water flow 34, through downstream channel mouth 44*a*, into the swimming pool water 14. Thus, a venturi effect will be produced, to draw ambient air to mix into and dissolve within water returning into the swimming pool.

Figure 5:
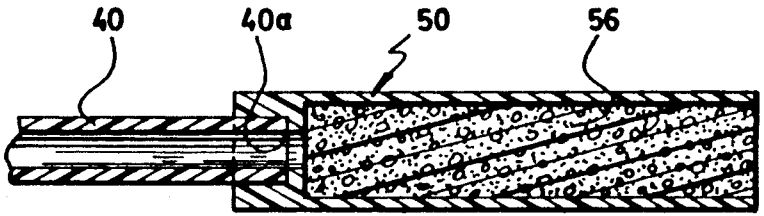
FIG. 5 is an enlarged sectional view along line 5—5 of FIG. 4.

Straw 40 must be fairly rigid and long enough so that outer mouth 40*a* remain above water line 14*a* at all times in operative position, and in view thereof, straw 40 will preferably be elbowed at 40*c* for such a reason. Handle 50 allows ambient air freely through the straw outer mouth 40*a*. Preferably, hollow cylindrical handle 50 (open at both ends) includes macro-particle filtering means, such as an air permeable sponge member 56 (FIG. 5) which allows ambient air freely therethrough yet prevents airborne macro-particles from clogging the diametrally narrow passageway of cylindrical straw 40. Straw outer end section 40*a* is then anchored to handle 50 in any suitable fashion, e.g. by friction fit engagement in a socket pat thereof as clearly suggested in FIG. 5.

In the second embodiment of FIG. 3, aerator device 30 further includes two additional components: annular nut 54, and a tubular extension 58 defining radially outward screw threads at both ends thereof at 58*a*, 58*b*. Screw threads 48*a* and 24 mesh with one another, and pivotal body 42 is engaged partially into tube 58 about end 46, so that once again nut 564 will mount aerator 30 against water outlet 18 by screwing threaded end 58*b* of tubular extension 58.

It is understood that unthreaded flange 54*a* of screwed cap 54 prevents release of aerator channel member 42 from water outlet 18, yet allows pivotal motion thereof as a universal joint. In the operative condition of aerator 30, there is a friction fit engagement of spherical joint 42 with flange 54*a* and main tue mouth 22'—embodiment of FIG. 3*a*—or with flange 54*a* and extension tube mouth 58*b*—embodiment of FIG. 3—, to maintain the selected orientation of the aerator 30 after positional setting thereof with handle 50.

Axial channel 44 or axial bore 46*a* of nozzle 42 may have a variety of suitable shapes, including cylindrical shape, conical, cross-sectionally hexagonal octagonal. In the case the selected shape thereto is conical, the diametrally larger end should be about downstream mouth 44*a* (for channel 44) and about the end of axial bore 46*a* adjacent channel 44 (for axial bore 46*a*).

Preferred materials for manufacturing the present aerator device 10 includes; plastic materials, particularly polypropylene, synthetic vinyl, and ABX.

It is understood that for installing the present aerator receive 30, one has to first deactivate the pump means of the existing water recirculating system of the swimming pool. Additionally, in the pool water recirculating system is equipped with more than one water outlet fitting, the other water outlet fittings should be sealed or each provided with an additional aerator device 30.

I claim:

1. An oxygenating device for use with a water filtering recirculating system of a swimming pool enclosing a large body of water, in view of dissolving oxygen into the filtered water returned into said large body of water, said oxygenating device consisting of:

(a) nozzle means, to be submerged into said pool water in register with a submerged water outlet port of said recirculation system;

(b) oxygen feedmans, or feeding oxygen to said nozzle means;

(c) mount means, for mounting said nozzle means against said water outlet port;

said nozzle means including channel having an upstream end, opening into said system water outlet port, and a downstream end, opening into said large body of water, whereby said filtered water will flow through said channel; said oxygen feed means including oxygen intake means, and oxygen outlet means located into said nozzle channel intermediate said upstream and downstream ends thereof, wherein said filtered water flow through said nozzle channel generates a venturi effect about said oxygen outlet means, thereby generating an oxygen flow from said oxygen intake means, through said oxygen outlet means, and into said channel, where oxygen is dissolved into said filtered water during escape into said large body of water;

said mount means being of the type enabling relative movement of said nozzle means about said water outlet port, for directional adjustment of water flow of filtered water returned to said large body of water; said oxygen feed means consisting of an elongated standpipe, releasable mounted to said nozzle means at an inner end, and defining an outer end located above the water line of said large body of water and forming a handle for manual control of said relative motion of said nozzle means, for said directional adjustment of filtered water flow, whereby ambient air is flowable freely through said standpipe into said nozzle channel;

wherein said nozzle means consists of a semi-spherical body defining: a diametrally largest intermediate section, and a diametrally smallest tangential end section at said nozzle channel upstream end; said water outlet port of said recirculating system defining an outlet duct mouth, projecting short of said large body of water nd having a radially inward threaded portion; and said mount means consisting of; an elongated tubular extension, defining upstream and downstream end mouths, each of the latter mouths having a a radially outwardly threaded section and a generally circular radially inward section, said tubular extension upstream end screwingly meshing with said threaded outlet duct mouth, said tubular extension downstream end mouth being diametrally intermediate said nozzle intermediate section and said nozzle tangential end section, and an annular nut, having a threaded section, for screwingly engaging said tubular extension downstream end, and an unthreaded radially inturned flange, said nozzle intermediate section being diametrally intermediate said nut threaded section and said nut flange, whereby said semi-spherical nozzle is rotatably, frictionally taken in sandwich between said nut and said tubular extension downstream end mouth before the latter are screwed to one another with said diametrally smallest tangential end section of said semi-spherical body being partially engaged into said tubular extension downstream end mouth for rotation of said nozzle body therein.

2. An oxygenating device for use with a water filtering recirculation system of a swimming pool enclosing a large body of water, in view of dissolving oxygen into the filtered water returned into said large body of term, said oxygenating device consisting of;

(a) nozzle means, to be submerged into said pool water in register with a submerged water outlet port of said recirculation system;

(b) oxygen feed means, of feeding oxygen to said nozzle means;

(c) mount means, or mounting said nozzle means against said water outlet port;

said nozzle means including channel having an upstream end, opening into said steam water outlet port, and downstream end, opening into said large body of water, whereby said filtered water will flow through said channel; said oxygen feed means including oxygen intake means, and oxygen outlet means located into said nozzle channel intermediate said upstream and downstream ends thereof, wherein sis filtered water flow through said nozzle channel generates a venturi effect about said oxygen outlet means, thereby generating an oxygen flow from said oxygen intake means, through said oxygen outlet means, and into said channel, where oxygen is dissolved into said filtered water during escape into said large body of water;

said mount means being of the type enabling relative movement of said nozzle means about said water outlet port, for directional adjustment of water flow of filtered water returned to said large body of water; said oxygen feed means consisting of an elongated standpipe, releasable mounted to said nozzle means at an inner end, and defining an outer end located above the water line of said large body of water and forming a handle for manual control of said relative motion of said nozzle means, for said directional adjustment of filtered water flow, whereby ambient air is flowable freely through said standpipe into said nozzle channel;

wherein said nozzle means consists of a semi-spherical body defining: a diametrally largest intermediate section, and a diametrally smallest tangential end section at said nozzle channel upstream end; said water outlet port of said recirculating system defining an outlet duct mouth projecting into said large body of after, said duct mouth having a radially outward threaded portion and radially inward portion defining a generally circular section diametrally intermediate said nozzle intermediate section and said nozzle tangential end section, whereby said diametrally smallest tangential end section of semi-spherical body is to be partially engaged into said duct mouth for rotation of said nozzle therein; and said mount means consisting of an annular nut having a threaded section, for screwingly engaging said duct mouth threaded portion, and an unthreaded radially inturned flange, said nozzle intermediate section being diametrally intermediate said nut threaded section and said nut flange, whereby said semi-spherical nozzle is rotatably, frictionally taken in sandwich between said nut flange and said duct mouth radially inward portion before said nut and duct mouth threaded portion are screwed to one another.

* * * * *